US005080052A

United States Patent [19]

Hotta et al.

[11] Patent Number: 5,080,052

[45] Date of Patent: Jan. 14, 1992

[54] VARIABLE VALVE TIMING SYSTEM IN AN ENGINE HAVING A ROTATING CAM-SHAFT

[75] Inventors: Koji Hotta, Ama; Junichi Kano, Kariya; Kongoh Aoki, Toyota, all of Japan

[73] Assignee: Aisin Seiki Kabushiki Kaisha, Kariya, Japan

[21] Appl. No.: 674,154

[22] Filed: Mar. 25, 1991

[30] Foreign Application Priority Data

Mar. 31, 1990 [JP] Japan ..... 2-85886

[51] Int. Cl.[5] ..... F01L 1/34

[52] U.S. Cl. ..... 123/90.17; 123/90.31

[58] Field of Search ..... 123/90.15, 90.17, 90.31

[56] References Cited

U.S. PATENT DOCUMENTS

| | | | |
|---|---|---|---|
| 4,601,266 | 7/1986 | Oldfield et al. | 123/90.15 |
| 4,811,698 | 3/1989 | Akasaka et al. | 123/90.31 |
| 4,841,924 | 6/1989 | Hampton et al. | 123/90.17 |
| 4,856,465 | 8/1989 | Denz et al. | 123/90.15 |

FOREIGN PATENT DOCUMENTS 62-3111 1/1987 Japan .

*Primary Examiner*—E. Rollins Cross
*Assistant Examiner*—Weilun Lo
*Attorney, Agent, or Firm*—Oblon, Spivak, McClelland, Maier & Neustadt

[57] ABSTRACT

A variable valve timing system includes a first timing member driven by the engine, a second timing member rotatably fixed to the crankshaft, a helical device engaged between the first and second timing members and including a piston movable for adjusting an angular position between the first and second timing members, a hydraulic circuit device for selectively applying a hydraulic pressure to the piston for selectively moving the piston to adjust the angular position, and a damper device on the first and second timing members for hydraulically damping rotational vibrations between the first timing member and the second timing member. The damper device includes the first timing member, a ring-member engaged with the second timing member and a viscous fluid between the first timing member and the ring-member.

5 Claims, 3 Drawing Sheets

VARIABLE VALVE TIMING SYSTEM IN AN ENGINE HAVING A ROTATING CAM-SHAFT

BACKGROUND OF THE INVENTION

1. Field of the Invention

The present invention relates to a variable valve timing system in an engine having a rotating cam-shaft and more particularly to a variable valve timing system in an engine having a rotating cam-shaft for driving intake and exhaust valves.

2. Description of the Related Art

A conventional variable valve timing system is disclosed in Japanese Patent Publication Laid-open Print No. 62(1987)-3111 published without examination, and is shown in FIG. 5. The variable valve timing system 500 is used for an engine of a vehicle (not shown). In the variable valve timing system 500, a timing pulley 501 has an inner helical gear 501*a* and an outer gear 501*b*. The outer gear 501*b* is geared with a timing belt 502. A cam-shaft 503 is rotatably supported in a cylinder-head 506 of the engine and has an oil conduit 503*a* formed therein. A cylindrical member 504 forms an outer helical gear 504*a* and is held on the cam-shaft 503 by a hollow bolt 507.

A cylindrical piston system 505 includes a first piston 505*a*, a second piston 505*b*, a plate 505*c*, a first spring 505*d* and a second spring 505*e*. The first piston 505*a* and the second piston 505*b* have inner helical gears 505*a*-1 and 505*b*-1 and outer helical gears 505*a*-2 and 505*b*-2, respectively. The inner helical gears 505*a*-1 and 505*b*-1 are geared with the outer helical gear 504*a*. The outer helical gears 505*a*-2 and 505*b*-2 are geared with the inner helical gear 501*a*.

The first piston 505*a* is operatively connected with the plate 505*c*. The first spring 505*d* is interposed between the first piston 505*a* and the second piston 505*b*, so that the first piston 505*a*, the second piston 505*b* and the first spring 505*d* constitute a scissors gear system for decreasing backlash.

A cam-shaft cover 508 is fixed to the timing pulley 501 by bolts 509. A pressure chamber 510 is formed between the plate 505*c* and the cam-shaft cover 508. The pressure chamber 510 is in fluid communication with the oil conduit 503*a* via the hollow bolt 507.

In the above-mentioned variable valve timing system 500, the timing belt 502 is driven by a crank-shaft of the engine (not shown). Thus, the timing pulley 501 is rotated by the timing belt 502, and the cam-shaft 503 is rotated through the cylindrical piston system 505. The cam-shaft 503 drives some intake and exhaust valves of the engine (not shown), so that some intake and exhaust valves are opened or closed. A change of the revolution speed of the engine requires a change in the timing by which these valves are opened or closed.

In the pressure chamber 510, there is provided high-pressure oil supplied from an oil tank (not shown) through a control valve (not shown) and the oil conduit 503*a*. This causes the cylindrical piston system 505 to move in the rightward direction. Therefore, the relative angle between the timing pulley 501 and the cam-shaft 503 is changed by the helical gears 501*a*, 505i a-2 and 505*b*-2 between the timing pulley 501 and the cylindrical piston system 505 and by the helical gears 505*a*-1, 505*b*-1 and 504*a* between the cylindrical piston system 505 and the cam-shaft 503. Consequently, the timing by which some intake and exhaust valves is opened or closed is changed.

In the normal driving of the engine, the cylindrical piston system 505 receives a torque variation from the cam-shaft 503 as the cam lobes sequentially engage and disengage the cam followers, producing rotational vibrations between the timing pulley and the cam-shaft. As a result, the cylindrical piston system 505 may move in the rightward direction, even though the high pressure oil is not supplied to the pressure chamber 510. Thus, the spring 505*e* must be strong to avoid such movement of the cylindrical piston system 505.

SUMMARY OF THE INVENTION

Accordingly, it is a primary object of the present invention to absorb a torque variation of a cam-shaft in a variable valve timing system.

The above and other objects are achieved according to the present invention by a variable valve timing system in an engine having a rotating cam-shaft which comprises a first timing member driven by the engine, a second timing member rotatably fixed to the crankshaft, helical means engaged between the first and second timing members and including a piston movable for adjusting an angular position between the first and second timing members, hydraulic circuit means for selectively applying a hydraulic pressure to the piston for selectively moving the piston to adjust the angular position, and damper means on the first and second timing members for hydraulically damping rotational vibrations between the first timing member and the second timing member, wherein the damper means comprises the first timing member, a ring-member engaged with the second timing member and a viscous fluid between the first timing member and the ring-member.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein.

DETAILED DESCRIPTION OF THE PREFERRED EMBODIMENT

Figure 1:
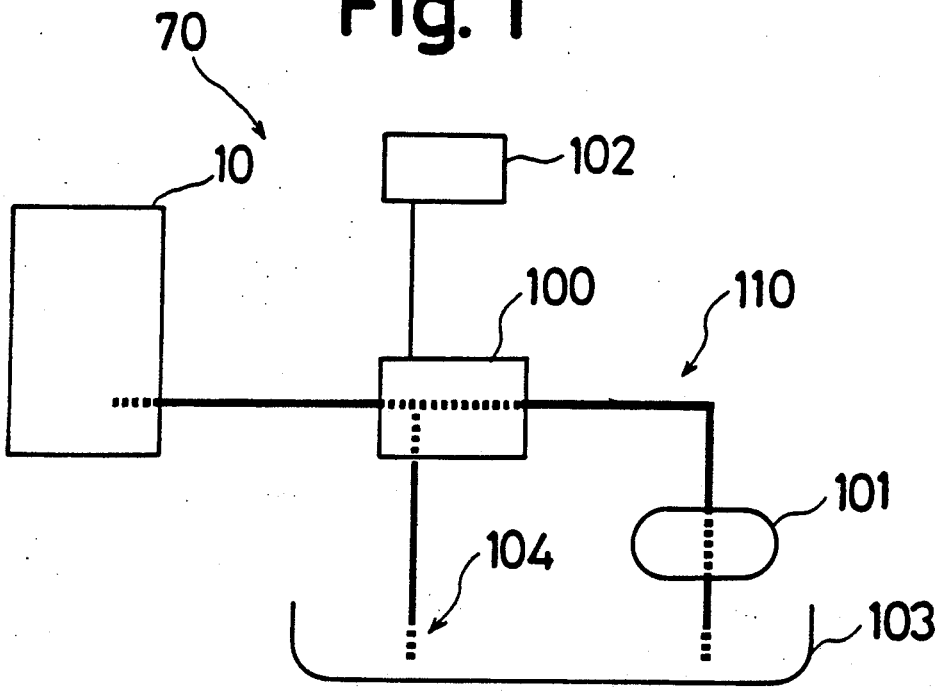
FIG. 1 is a block diagram of a variable valve timing system according to the invention.
Figure 3:
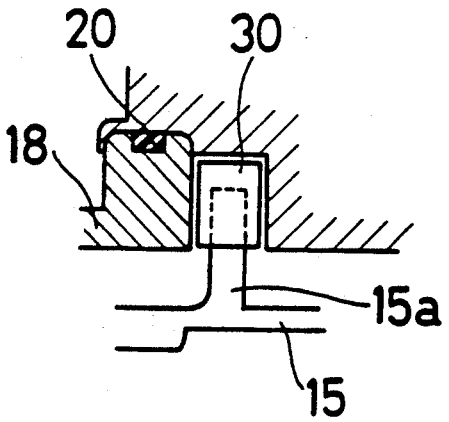
FIG. 3 is an enlarged cross-sectional view of a damper means of FIG. 2.
Figure 4:
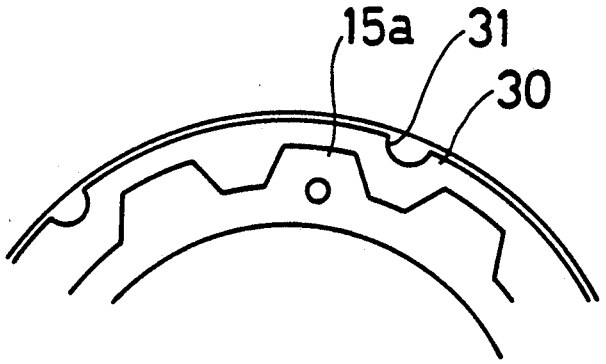
FIG. 4 is an enlarged front view of a damper means of FIG. 2.
Figure 2:
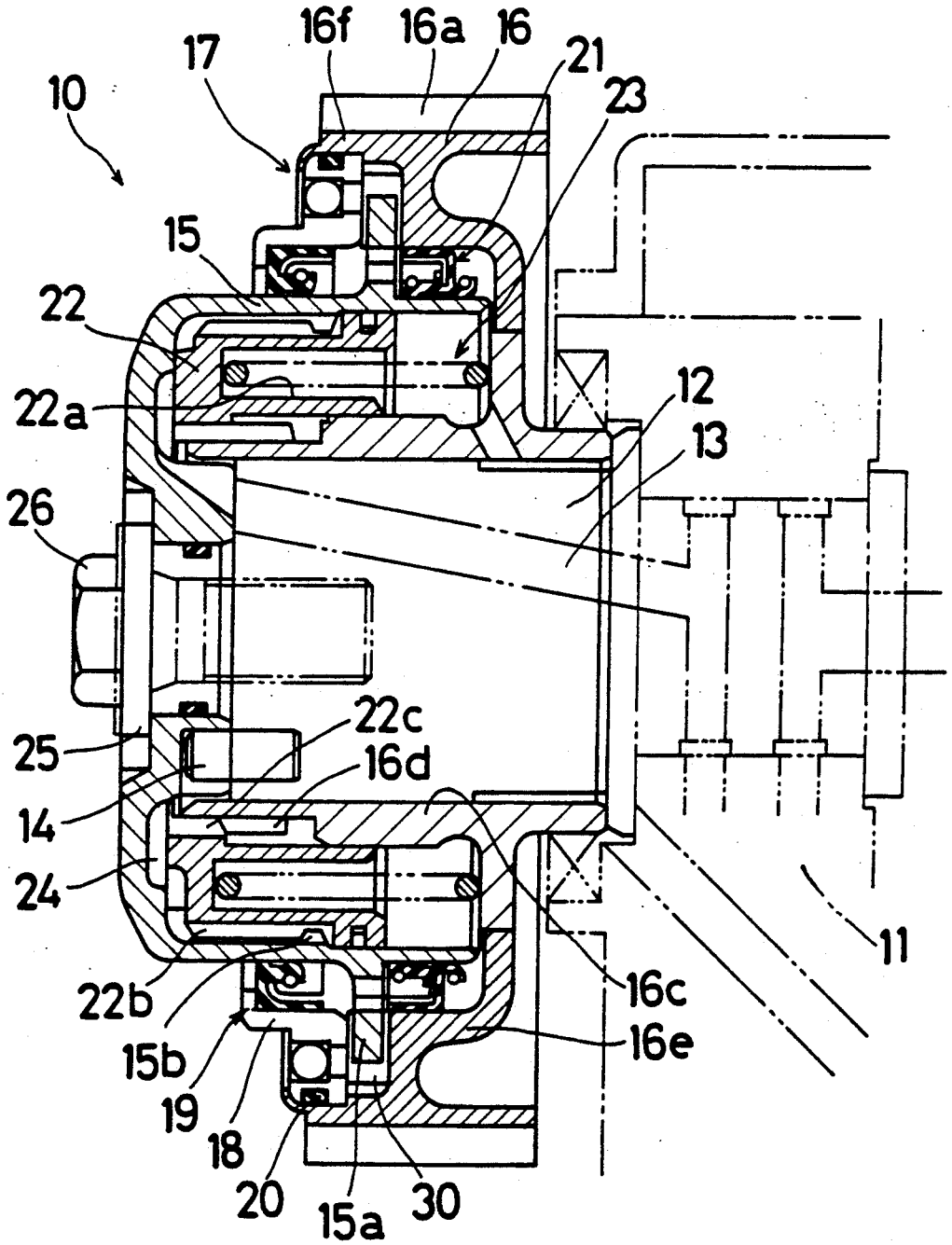
FIG. 2 is a cross-sectional view of a variable valve timing means according to the invention.
Figure 5:
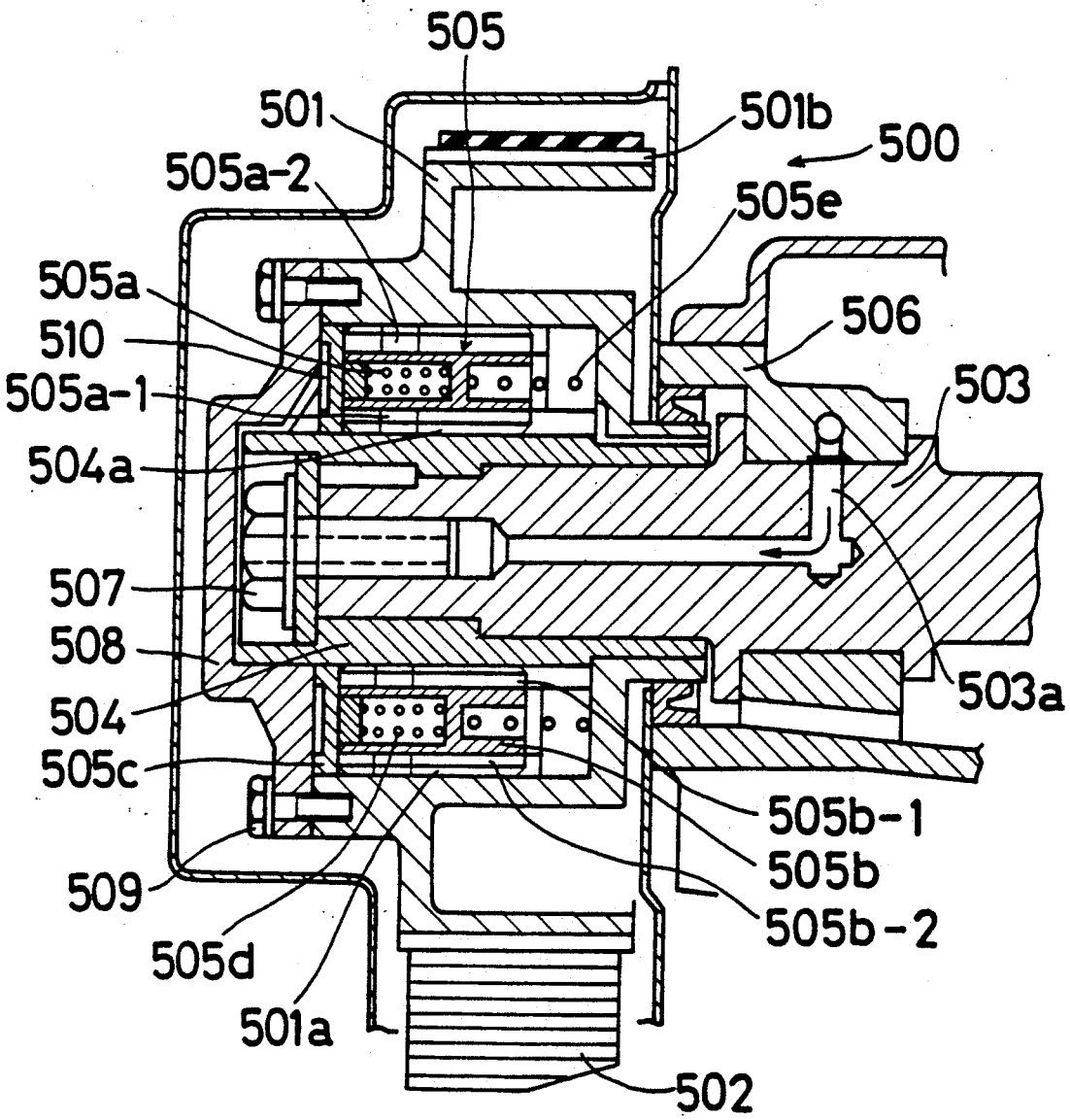
Fig. 5 PRIOR ART
FIG. 5 is a cross-sectional view of a conventional variable valve timing means.

Referring first to the embodiment of the present invention shown in FIGS. 1, 2, 3 and 4, wherein a variable valve timing system 70 is shown. A high pressure oil source (e.g., oil pump) 101 is in fluid communication with a variable valve timing means 10 or a drain portion 104 by action of a control valve 100. The control valve 100 is controlled by the central processing unit 102. The high pressure oil source and drain portion 104 are in fluid communication with an oil-pan of an engine (not shown). Namely, the variable valve timing system 70 is controlled by a hydraulic circuit means 110.

In the variable valve timing means 10, a cam-shaft 12 of the engine is rotatably supported by a cylinder-head 11, and has an oil conduit 13 formed therein. A timing pulley 16 (first timing member) is rotatably supported on the cam-shaft 12, and has an outer gear 16*a* which is meshed with a timing belt (not shown). An outer surface of a cylindrical portion 16*c* of the timing pulley 16 has an outer helical gear 16*d*.

A cylindrical piston means 22 has a ring-shaped groove 22*a*, an outer helical gear 22*b* and an inner helical gear 22*c*. The inner helical gear 22*c* is geared with the outer helical gear 16*d*. A spring 23 is interposed between the inside of the ring-shaped groove 22*a* and the timing pulley 16. The spring 23 urges the cylindrical piston means 22 in the leftward direction as seen in the figure.

A damper case 15 (second timing member) has a flange portion 15*a* and an inner helical gear 15*b*. The inner helical gear 15*b* is geared with the outer helical gear 22*b*. A ring-shaped cover 18 is fixed to a flange portion 16*f* of the timing pulley 16 and sealed via a sealing member 20. A ring-member 30 is secured around the flange portion 15*a* and has a circular outer periphery in close proximity to the circular inner periphery of the timing pulley 16. A notch 31 is formed on the outer circumference face of the ring-member 30. An oil chamber 24 is located between the damper case 15 and the cylindrical piston means 22. The oil chamber 24 is in fluid communication with the oil conduit 13. The oil fills the annular space between the ring-member 30 and the timing pulley 16. The timing pulley 16 and the ring-member 30 thus form a viscous damper means 17 in which shearing of the oil in the gap between the ring member 30 and the timing pulley 16 damps rotational vibration. The damper case 15 is fixed to the cam-shaft 12 by knock pins 14 and a bolt 26 with a ring-shaped plate 25. Thus, the damper case 15 is not rotated relative to the camshaft 12. The piston 22 and the helical gears 15*b*, 16*d*, 22*b* and 22*c* together comprise helical means for adjusting an angular position between the first and second timing members.

The ring-shaped cover 18 is contacted with the damper case 15 and sealed via a sealing member 19. A sealing member 21 is interposed between the damper case 15 and an arm portion 16*e*. Thus, the viscous fluid accommodated in the viscous damper means 17 does not leak.

The oil conduit 13 is in fluid communication with the control valve 100. A signal from the revolution speed sensor (not shown) of the engine, a signal from a load sensor (not shown) of the engine and a signal from a water-temperature sensor (not shown) of the engine, etc., are inputted to the central processing unit 102, and the central processing unit 102 outputs the driving current to the control valve 100.

The operation of the variable valve timing system 70 according to the embodiment is described hereinafter. The driving force of the engine is transmitted to the timing pulley 16 by the timing belt, so that the timing pulley 16 is rotated. The rotation of the timing pulley 16 is transmitted to the cam-shaft 12 through the outer helical gear 16*d*, the inner helical gear 22*c*, the cylindrical piston means 22, the outer helical gear 22*b*, the inner helical gear 15*b*, the damper case 15 and the knock pins 14.

Consequently, an intake valve and/or an exhaust valve (not shown) are driven by the cam-shaft 12 via a cam (not shown). At this time, the oil pressure is not applied to the oil chamber 24, so that the cylindrical piston means 22 is urged in the leftward direction (i.e., a direction to reduce the size of oil chamber 24) by the spring 23. Consequently, the certain definite valve timing is established.

In this definite condition of the valve timing, the timing pulley 16 is subjected to torque variations from the cam-shaft 12 via the cylindrical piston means 22. There is thus a danger of rotational vibrations in the angular positions of the first and second timing members changing the relative angle between the timing pulley 16 and the cam-shaft 12, thereby producing an altered valve timing. However, the viscosity damper means 17 absorbs any such vibrations due to the torque variation. Namely, the large shearing resistance of viscous fluid between the timing pulley 16 and the ring-member 30 absorbs the torque variations. Thus, the relative angle between the timing pulley 16 and the cam-shaft 12 is not changed, and the valve timing is unaltered.

Now, if the running condition of the engine changes, i.e., the revolution speed of the engine, the load of the engine and/or the water-temperature of the engine etc., it is desirable that the valve timing of the intake valves and/or the exhaust valves are changed, because the intake air quantity which the engine needs changes according to the running condition of the engine.

At this time, the central processing unit 102 outputs driving current to the control valve 100. As a result, the high pressure oil flows from the high pressure oil source 101 to the oil chamber 24 through the control valve 100 and the oil conduit 13.

Because of the flowing of the high pressure oil into the oil chamber 24, the cylindrical piston means 22 is moved in the rightward direction against the urging force of the spring 23. By means of the helical gears 15*b*, 22*b*, 22*c*, 16*d*, the relative angle between the timing pulley 16 and the cam-shaft 12 is changed, so that the valve timing of the intake valve and/or the exhaust valve is changed.

Next, if running conditions again change so that it is no longer desirable that the valve timing of the intake valve and the exhaust valve are changed, the central processing unit 102 stops outputting the driving current. Thus, the oil in the oil chamber 24 flows to the oil-pan 103 through the oil conduit 13 and the control valve 100, so that the cylindrical piston means 22 is moved in the leftward direction according to the urging force of the spring 23. Thus, the relative angle between the timing pulley 16 and the cam-shaft 12 is returned to its original condition, so that the valve timing of the intake and/or the exhaust valve is returned to their original conditions.

In the above embodiment, there are many advantages as follows:

The torque variation from the cam-shaft 12 is absorbed by the viscous damper means 17 that is compact in size, so that the variable valve timing means 10 is also compact in size. Further, the viscous damper means 17 absorbs the backlash between the helical gear 15*b* and the helical gear 22*b* and between the helical gear 22*c* and the helical gear 16*d*. Thus, noise is not generated in the helical gears 15*b*, 22*b*, 22*c*, 16*d*. Further, the stiffness of the spring 23 can be small, so that the cylindrical piston means 22 can be moved by low oil pressure, i.e., when the revolution speed of the engine is low, the oil pressure is also low. Thus, the action of the variable valve timing system is not influenced by the revolution speed of the engine. Further, the response of the variable valve timing system becomes faster.

When the damper means 17 is assembled, air mixes with viscous fluid enclosed therein. However, when the damper means 17 acts, air is expelled through the notch 31. Thus, the action of the damper means 17 does not receive a bad influence from air mixed in the damper means 17.

Obviously, numerous modifications and variations of the present invention are possible in light of the above teachings. It is therefore to be understood that within the scope of the appended claims, the invention may be practiced otherwise than as specifically described herein.

WHAT IS CLAIMED AS NEW AND DESIRED TO BE SECURED BY LETTERS PATENT OF THE UNITED STATES IS:

1. A variable valve timing system in an engine having a rotating cam-shaft comprising:

a first timing member driven by the engine;

a second timing member rotatably fixed to the cam-shaft;

helical means engaged between the first and second timing members and including a piston movable for adjusting an angular position between the first and second timing members;

hydraulic circuit means for selectively applying a hydraulic pressure to the piston for selectively moving the piston to adjust the angular position; and damper means on the first and second timing members for hydraulically damping rotational vibrations between the first timing member and the second timing member;

wherein the damper means comprises the first timing member, a ring-member engaged with the second timing member and forming an annular gap with the first timing member, and a viscous fluid in the gap between the first timing member and the ring-member.

2. A variable valve timing system as set forth in claim 1, wherein the first timing member comprises a timing pulley rotatably mounted on the cam-shaft and a ring-shaped cover fixed to the timing pulley, and the second timing member comprises a damper case cooperating with the piston to define an oil chamber.

3. A variable valve timing system as set forth in claim 2, wherein the helical means comprises inner and outer gears on the piston, a helical gear on the timing pulley and meshing with the inner gear, and a helical gear on the damper case and meshing with the outer gear.

4. A variable valve timing system as set forth in claim 3, including a spring for biasing the piston so as to reduce the size of the oil chamber.

5. A variable valve timing system as set forth in claim 1, including a notch formed on the outer circumference face of the ring-member.

* * * * *